US009183961B2

(12) United States Patent
Fadler et al.

(10) Patent No.: US 9,183,961 B2
(45) Date of Patent: Nov. 10, 2015

(54) ADAPTIVE X-RAY FILTER AND METHOD FOR ADAPTIVE ATTENUATION OF X-RAY RADIATION

(71) Applicants: Franz Fadler, Hetzles (DE); Hans Liegl, Erlangen (DE); Reiner Franz Schulz, Erlangen (DE)

(72) Inventors: Franz Fadler, Hetzles (DE); Hans Liegl, Erlangen (DE); Reiner Franz Schulz, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 281 days.

(21) Appl. No.: 13/870,920

(22) Filed: Apr. 25, 2013

(65) Prior Publication Data

US 2013/0287179 A1 Oct. 31, 2013

(30) Foreign Application Priority Data

Apr. 26, 2012 (DE) ..... 10 2012 206 953

(51) Int. Cl.
*G21K 3/00* (2006.01)
*G21K 1/10* (2006.01)

(52) U.S. Cl.
CPC ..... *G21K 1/10* (2013.01)

(58) Field of Classification Search
CPC ..... G21K 1/10
USPC ..... 378/156–159
See application file for complete search history.

(56) References Cited

U.S. PATENT DOCUMENTS

| | | | | |
|---|---|---|---|---|
| 3,755,672 | A | 8/1973 | Edholm et al. | |
| 5,242,372 | A * | 9/1993 | Carol | 600/1 |
| 5,559,853 | A * | 9/1996 | Linders et al. | 378/159 |
| 5,625,665 | A * | 4/1997 | Fokkink et al. | 378/156 |
| 5,666,396 | A * | 9/1997 | Linders et al. | 378/156 |
| 5,751,786 | A * | 5/1998 | Welters et al. | 378/156 |
| 5,768,340 | A * | 6/1998 | Geittner et al. | 378/159 |
| 5,778,046 | A * | 7/1998 | Molloi et al. | 378/159 |
| 5,878,111 | A | 3/1999 | Schulz | |
| 5,881,127 | A * | 3/1999 | Molloi et al. | 378/159 |
| 5,966,426 | A * | 10/1999 | Marra et al. | 378/159 |
| 6,061,426 | A * | 5/2000 | Linders et al. | 378/149 |
| 6,118,855 | A * | 9/2000 | Welters et al. | 378/158 |
| 6,181,774 | B1 * | 1/2001 | Prins et al. | 378/159 |
| 6,188,749 | B1 | 2/2001 | Schiller et al. | |
| 6,198,806 | B1 * | 3/2001 | Prins | 378/159 |
| 6,226,355 | B1 * | 5/2001 | Prins | 378/158 |
| 6,252,939 | B1 * | 6/2001 | Young et al. | 378/156 |

(Continued)

FOREIGN PATENT DOCUMENTS

| | | |
|---|---|---|
| DE | 2159365 A1 | 7/1972 |
| DE | 4422780 A1 | 1/1996 |

(Continued)

OTHER PUBLICATIONS

German Office Action dated Oct. 17, 2012 for corresponding German Patent Application No. DE 10 2012 206 953.4 with English translation.

*Primary Examiner* — Allen C. Ho
(74) *Attorney, Agent, or Firm* — Lempia Summerfield Katz LLC

(57) ABSTRACT

An adaptive x-ray filter and an associated method for changing a local intensity of x-ray radiation are provided. The adaptive x-ray filter includes a first fluid absorbing x-ray radiation and hydraulically moveable positioning elements that change the layer thickness of the first fluid at a location of the respective positioning element by being able to at least partly displace the first fluid.

18 Claims, 4 Drawing Sheets

(56) References Cited

U.S. PATENT DOCUMENTS

| | | | | |
|---|---|---|---|---|
| 6,269,147 | B1 * | 7/2001 | Powell | 378/158 |
| 6,275,568 | B1 * | 8/2001 | Prins et al. | 378/158 |
| 6,289,081 | B1 * | 9/2001 | Weekamp et al. | 378/156 |
| 6,370,228 | B1 * | 4/2002 | Mockler et al. | 378/158 |
| 6,424,698 | B1 * | 7/2002 | Weekamp et al. | 378/156 |
| 6,426,999 | B2 * | 7/2002 | Prins | 378/156 |
| 6,430,265 | B2 * | 8/2002 | Prins et al. | 378/158 |
| 6,438,211 | B1 * | 8/2002 | Weekamp et al. | 378/158 |
| 6,440,527 | B2 * | 8/2002 | Prins et al. | 428/118 |
| 6,453,012 | B2 * | 9/2002 | Herbert | 378/158 |
| 6,453,013 | B2 * | 9/2002 | Prins | 378/158 |
| 6,473,492 | B2 * | 10/2002 | Prins et al. | 378/158 |
| 6,584,173 | B2 * | 6/2003 | Zwart et al. | 378/158 |
| 6,611,578 | B2 * | 8/2003 | Snoeren et al. | 378/158 |
| 6,836,535 | B2 * | 12/2004 | Toth et al. | 378/159 |
| 7,082,189 | B2 * | 7/2006 | Yahata et al. | 378/156 |
| 7,308,073 | B2 * | 12/2007 | Tkaczyk et al. | 378/16 |
| 7,652,273 | B2 * | 1/2010 | Cernasov | 250/515.1 |
| 2013/0301807 | A1 * | 11/2013 | Bernhardt et al. | 378/158 |
| 2013/0322604 | A1 * | 12/2013 | Liegl et al. | 378/159 |

FOREIGN PATENT DOCUMENTS

| | | | |
|---|---|---|---|
| DE | 19638621 | C1 | 2/1998 |
| DE | 69908494 | T2 | 5/2004 |
| NL | 8903110 | A | 7/1991 |

* cited by examiner

ADAPTIVE X-RAY FILTER AND METHOD FOR ADAPTIVE ATTENUATION OF X-RAY RADIATION

This application claims the benefit of DE 10 2012 206 953.4, filed on Apr. 26, 2012, which is hereby incorporated by reference.

TECHNICAL FIELD

The present embodiments relate to an adaptive x-ray filter and an associated method for changing a local intensity of x-ray radiation by locally changing a layer thickness of a fluid absorbing x-ray radiation.

BACKGROUND

In examinations using x-ray radiation, the patient or organs of the patient in an area to be examined exhibit very different absorption behavior with respect to the applied x-ray radiation. For example, in thorax images, the attenuation in the area in front of the lungs is very large on account of the organs arranged in the area in the front of the lungs. The attenuation is very small in the area of the lungs itself. In order both to obtain a meaningful image and also, for example, to protect the patient, the applied dose may be adjusted depending on the area such that no more x-ray radiation than is required is supplied. This provides that a larger dose is to be applied in areas with a large attenuation than in areas with a lower attenuation. In addition, there are applications in which only part of the examined area is to be imaged with a good diagnostic quality (e.g., with little noise). The surrounding parts are important for the orientation but not for the actual diagnosis. These surrounding areas may therefore be imaged with a lower dose in order to reduce the overall dose applied.

Filters are used to attenuate x-ray radiation. A filter of this type is known, for example, from DE 44 22 780 A1. The filter has a housing with a controllable electrode matrix, by which an electric field that acts on the fluid connected to the electrode matrix, in which fluid ions absorbing x-ray radiation are present, is generated. These are freely moveable and move around as a function of the applied field. By virtue of the corresponding electrical field, more or fewer ions may be accumulated correspondingly in the area of one or several electrodes in order to locally change the absorption behavior of the filter.

SUMMARY AND DESCRIPTION

The scope of the present invention is defined solely by the appended claims and is not affected to any degree by the statements within this summary.

The present embodiments may obviate one or more of the drawbacks or limitations in the related art. For example, an adaptive x-ray filter and an associated method that attenuate x-ray radiation as a function of location in a simple, safe, precise and stable manner are provided.

Positioning elements that are arranged in a honeycomb shape or orthogonally and may be moved hydraulically are able to locally change a layer thickness of a first fluid absorbing x-ray radiation. This changes the local absorption behavior of the filter. More x-ray radiation reaches an object with a minimal layer thickness than with a greater layer thickness. The x-ray radiation may therefore be modulated in two dimensions.

In one embodiment, an adaptive x-ray filter for changing the local intensity of x-ray radiation is provided. The x-ray filter includes a first fluid absorbing x-ray radiation (e.g., Galinstan), and hydraulically-moveable positioning elements that change the layer thickness of the first fluid at the location of the respective positioning element by at least partly displacing the first fluid. One or more of the present embodiments are advantageous in that the radiation field of x-ray radiation may be modulated in a simple, precise and rapid manner.

In one development, the positioning elements may be arranged in a plane at right angles to the x-ray radiation. The positioning elements therefore form a matrix that may be embodied in the manner of honeycomb.

In a further embodiment, the x-ray filter includes a flexible first membrane that is transparent for x-ray radiation and separates the first fluid from the positioning elements. The first membrane is moved by the positioning elements. The layer thickness of the first fluid is therefore changed locally with the aid of the first membrane.

The x-ray filter includes a cover plate arranged above the first fluid, in the direction of which the first membrane is pressed by the positioning elements. The cover plate and the first membrane form a chamber, in which the first fluid is located.

In a further embodiment, the x-ray filter includes a second fluid arranged below the first membrane, in which the positioning elements are arranged. The second fluid has similar x-ray radiation-absorbing properties to the positioning elements. This avoids unwanted structures through the positioning elements in the x-ray images.

In one development, the positioning element may be embodied in the shape of a mushroom and includes a cap and a stem.

The positioning elements may be surrounded by the second fluid.

The x-ray filter may include a flexible second membrane arranged below the positioning elements. The flexible second membrane may be moved hydraulically in a location-dependent manner in the direction of the positioning elements. As a result, the positioning element moves in the direction of the first fluid such that the positioning elements locally displace the layer thickness of the first fluid. The second membrane causes the second fluid to be held in a type of chamber.

In a further embodiment, the x-ray filter includes a distributor plate arranged below the second membrane having supply lines for a third fluid. With the aid of the supply lines for the third fluid, a hydraulic pressure is exerted on the positioning elements. The positioning elements may thus be moved hydraulically. The third fluid may flow into and out of the supply lines via mini valves.

A method for changing the local intensity of x-ray radiation using an adaptive x-ray filter is also provided. Positioning elements of the adaptive x-ray filter arranged in a plane are moved hydraulically. The layer thickness of a first x-ray radiation-absorbing fluid irradiated by x-ray radiation is thus changed at the location of the respective positioning element by the positioning elements being able to at least partly displace the first fluid.

DETAILED DESCRIPTION

Figure 1:
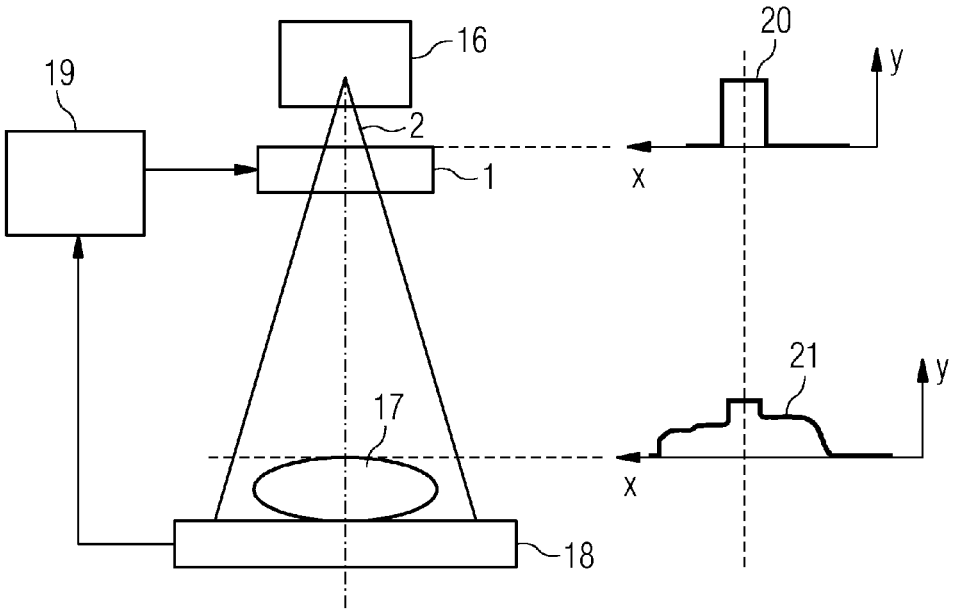
FIG. 1 shows the functional principle of an adaptive x-ray filter.

FIG. 1 shows the basic principle of location-dependent attenuation of x-ray radiation 2 through an adaptive x-ray filter 1. The x-ray radiation 2 is generated by an x-ray source 16, penetrates one embodiment of an adaptive x-ray filter 1, penetrates a patient 17, and is measured by an x-ray detector 18. The local attenuation of the x-ray radiation 2 is controlled by the adaptive x-ray filter 1 using a control unit 19.

An intensity profile 20 of the x-ray radiation 2 upstream of the adaptive x-ray filter 1 is shown schematically at the top right in FIG. 1. The intensity y is shown across axis x, which specifies the location. An almost even shape of the intensity y is shown in FIG. 1. The intensity profile 21, after passage through the adaptive x-ray filter 1, is shown schematically at the bottom right in FIG. 1. The change in local intensity y caused by the adaptive x-ray filter 1 is shown by the shape of the intensity profile 21.

Figure 2:
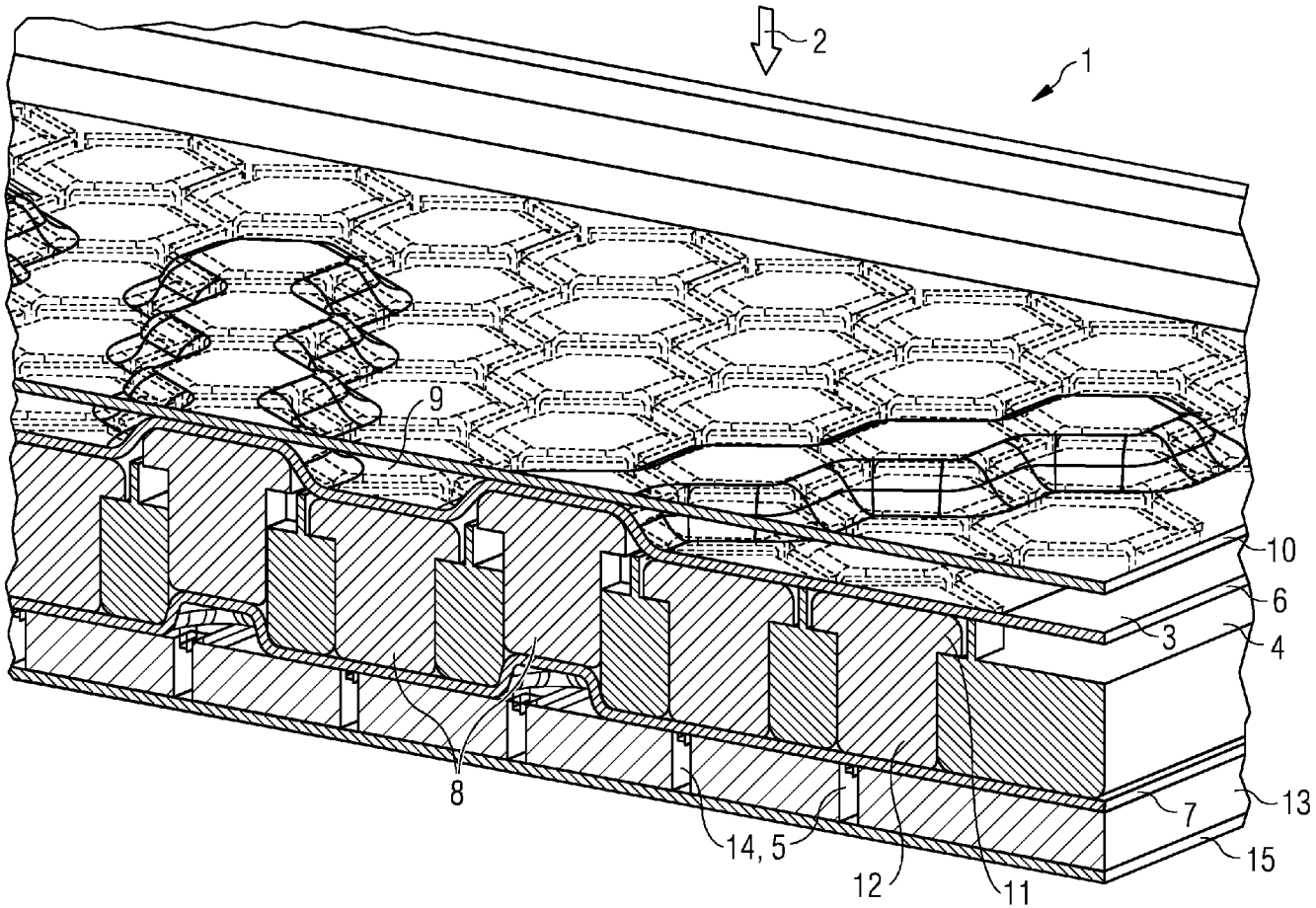
FIG. 2 shows a cross-section through one embodiment of an adaptive x-ray filter.

FIG. 2 shows one embodiment of an adaptive x-ray filter 1 in a cross-sectional view. A distributor plate 13 is arranged on a base plate 15 made of carbon fiber-reinforced plastic. The distributor plate 13 has a plurality of tubular supply lines 15, through which a fluid 4 (e.g., a second fluid) may flow in and out. The supply lines 14 end below positioning elements 8 arranged in the shape of a honeycomb so as to be moveable in a plane. A flexible second membrane 7 is located between the positioning elements 8 and the distributor plate 13 as a switching membrane. If a third fluid 5 is supplied via mini valves (not shown), the switching membrane 7 is lifted locally, and the positioning element 8 therefore moves hydraulically upwards (e.g., in the direction of an incident x-ray radiation 2).

The positioning elements 8 are embodied in the shape of mushrooms and have a cap 11 and a stem 12. The positioning elements 8 (e.g., the caps 11) are disposed in the second fluid 4, which has similar x-ray absorption properties to the positioning elements 8. This prevents unwanted structures formed by the positioning elements 8 from being visible in the x-ray image. The caps 11 are almost flush with one another.

A flexible first membrane 6, as a separating membrane, is arranged opposite to the direction of the incident x-ray radiation 2 above the positioning element 8. A cover plate 10 made of carbon fiber-reinforced plastic is located at a distance above the separating membrane 6. The cover plate 10 and the separating membrane 6 form a chamber in which a first fluid 3 absorbing x-ray radiation (e.g., a liquid metal such as Galinstan or colloidal solutions with x-ray absorbing elements) is enclosed. If the positioning element 8 is moved hydraulically upwards, the separating membrane 6 is moved upwards by the cap 11 of the positioning element 8 at a location of the cap 11 and thus displaces the first fluid 3 at the location of the cap 11. The x-ray radiation absorption herewith changes locally at the location of the cap 11, since a layer thickness 9 of the first fluid 3 is reduced. The honeycomb-type arrangement of the positioning elements 8 thus enables each profile to be approximated with respect to the location-dependent attenuation of x-ray radiation. The local resolution increases where smaller caps 11 are used for the positioning elements 8 and where the positioning elements 8 are packed tighter.

On account of a low pass effect, the separating membrane 6 prevents strong transitions (e.g., high frequency transitions) in the x-ray image, which is favorable for imaging.

The first fluid 3 and the second fluid 4 may not be filled through inlet openings (not shown). A differential pressure may also be applied to the separating membrane 6 through the inlet openings. Depending on the deflection of the separating membrane 6, the first fluid 3 and the second fluid 4 may be fed in or discharged.

In other words, the positioning elements 8 are moved hydraulically in the direction of the separating membrane 6 by a fluid pressure being applied via the supply lines 14 in the distributor plate 13. The supply lines 14 are controlled via mini valves (not shown). The positioning elements 8 are returned by applying a counter pressure via the first fluid 3 and the separating membrane 6 when the mini valves are open.

All positioning elements 8 are extended in the normal state and press against the separating membrane 6. This allows the first fluid 3 to escape from the chamber formed by the cover plate 10 and the separating membrane 6. The mini valves are closed. The adaptive x-ray filter 1 has the lowest absorption. In order to achieve an absorption modulation, the corresponding mini valves are opened, and a counter pressure is applied to the separating membrane 6 via the first fluid 3. The positioning elements 8 with associated opened mini valves are pushed back, the separating membrane 6 is deflected, and the first fluid 3 flows in therebehind. The absorbing layer thickness 9 of the first fluid 3 may therefore be locally modulated, and a non-uniform x-ray radiation field may therefore be set.

Figure 3:
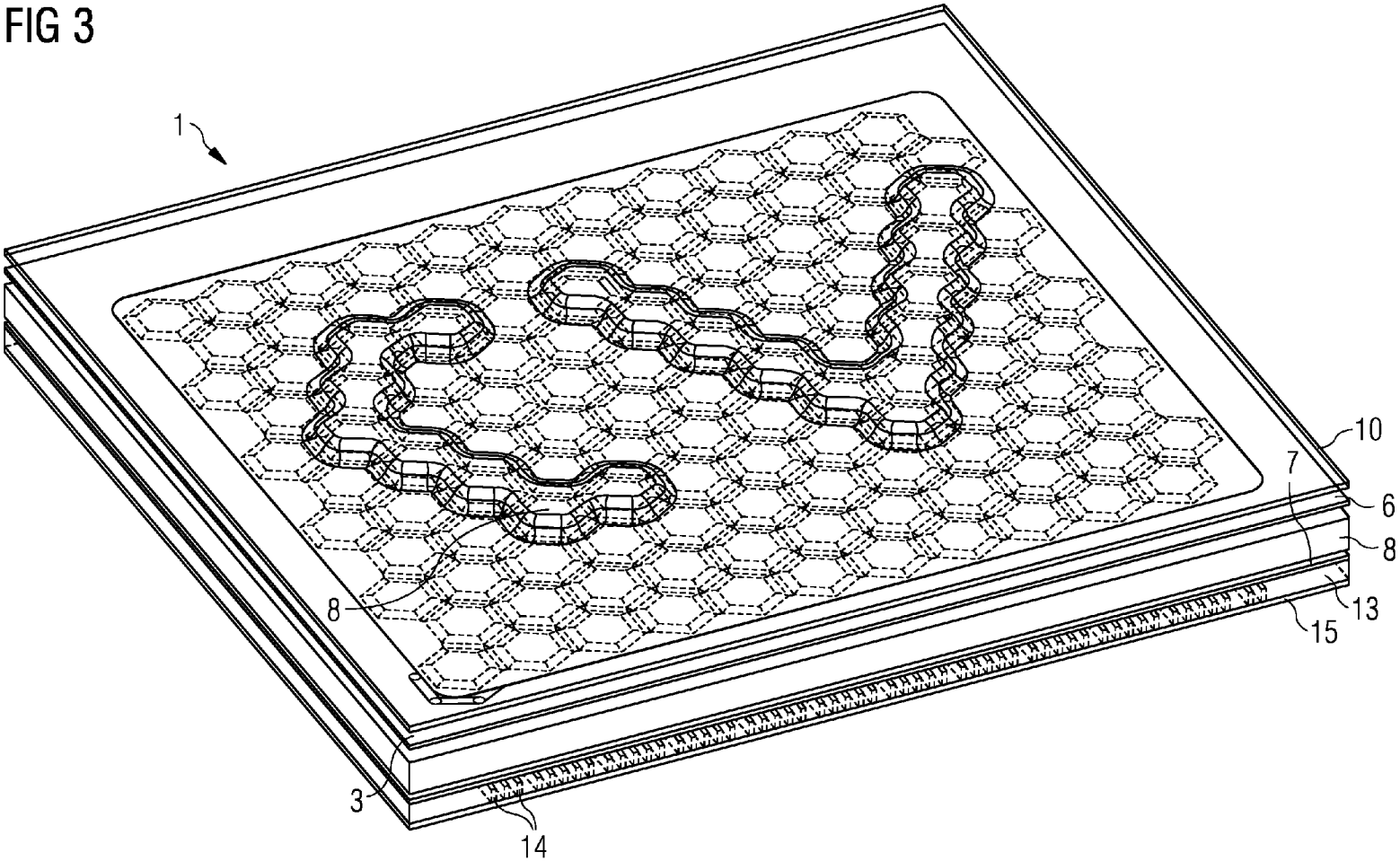
FIG. 3 shows a top view of one embodiment of an adaptive x-ray filter.

FIG. 3 shows a top view of one embodiment of an adaptive x-ray filter 1. The letters "C" and "V", which are formed by the extended positioning elements 8, are shown. The honeycomb structure of the positioning elements 8 arranged in a plane is shown. The adaptive x-ray filter 1 includes a base plate 15, upon which the distributor plate 13 with the supply lines 14 is arranged. The switching membrane 7 is disposed above the distributor plate 13. A layer with the positioning elements 8 that push on the separating membrane 6 lies above the switching membrane 7. A cover plate 10 closes the adaptive x-ray filter 1 at the top. The first fluid 3 is located between the cover plate 10 and the separating membrane 6. The positioning elements 8 lie in the second fluid 4, which is disposed between the separating membrane 6 and the switching membrane 7.

Figure 4:
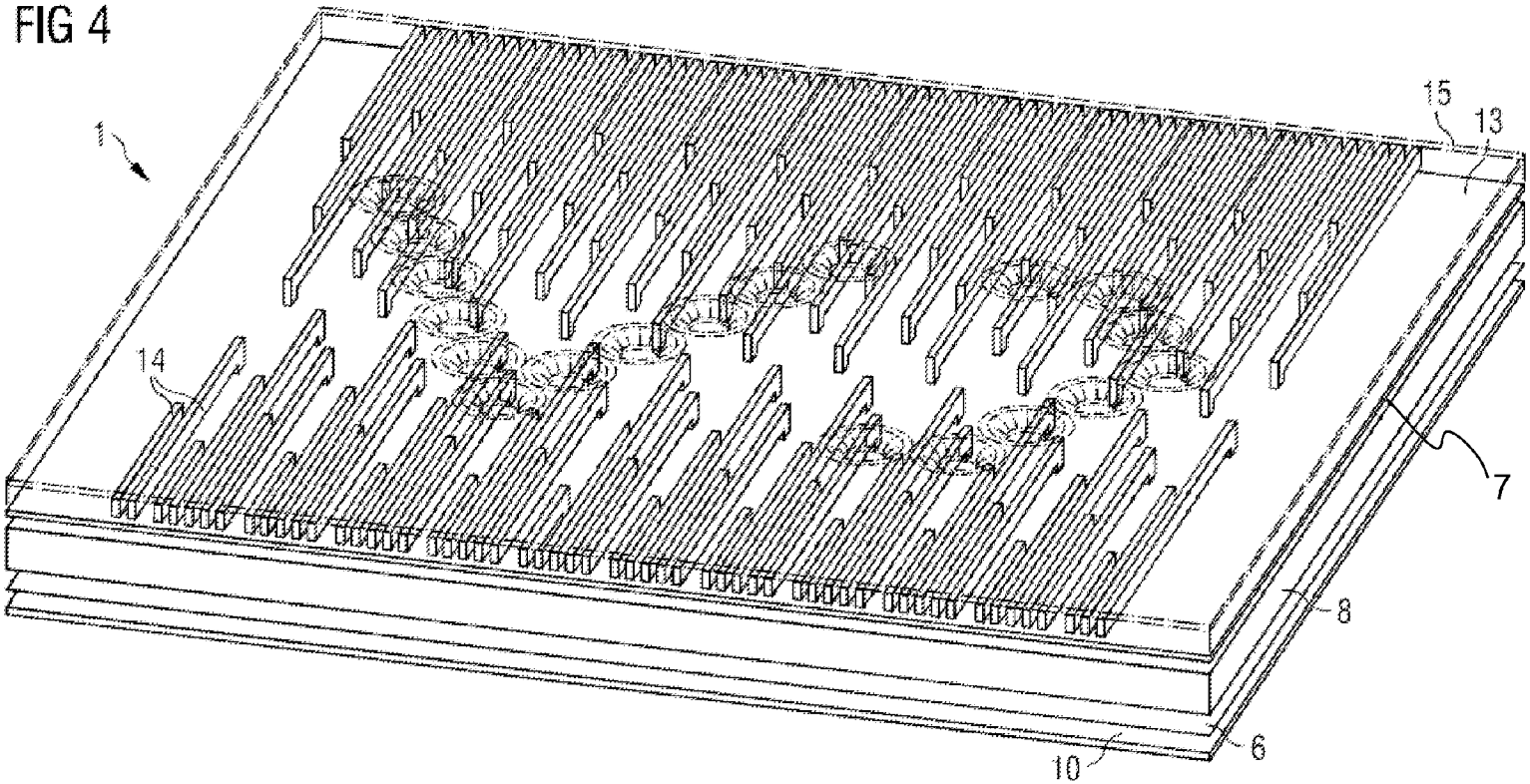
FIG. 4 shows a bottom view of one embodiment of an adaptive x-ray filter.

FIG. 4 shows a bottom view of one embodiment of an adaptive x-ray filter 1 in accordance with FIG. 3. For improved representation, the individual layers are shown in a partly transparent manner. FIG. 4 shows, from top down, the base plate 15, the distributor plate 13 with the supply lines 14 for applying pressure to the positioning elements 8, the switching membrane 7, the plane with the positioning elements 8, the separating membrane 6, and the cover plate 10. The supply lines 14 are arranged such that a supply line leads to each positioning element 8.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An adaptive x-ray filter for changing a local intensity of x-ray radiation, the adaptive x-ray filter comprising:

a first fluid operable to absorb at least some of the x-ray radiation;

positioning elements that are hydraulically moveable and are operable to change a layer thickness of the first fluid at a location of a respective positioning element of the positioning elements by at least partly displacing the first fluid; and a flexible first membrane that is transparent for the x-ray radiation, the flexible first membrane separating the first fluid from the positioning elements, wherein the flexible first membrane is moveable by the positioning elements.

2. The adaptive x-ray filter as claimed in claim 1, wherein the positioning elements are arranged in a plane at right angles to the x-ray radiation, in a honeycomb matrix, or in the plane at right angles to the x-ray radiation and in the honeycomb matrix.

3. The adaptive x-ray filter as claimed in claim 1, further comprising:

a cover plate arranged above the first fluid, wherein the flexible first membrane is pushable by the positioning elements, and wherein the cover plate and the flexible first membrane form a cavity for the first fluid.

4. The adaptive x-ray filter as claimed in claim 3, further comprising:

a second fluid arranged below the flexible first membrane, an x-ray radiation absorption property of the second fluid being the same as an x-ray radiation absorption property of the positioning elements.

5. The adaptive x-ray filter as claimed in claim 3, wherein each positioning element of the positioning elements is configured in the shape of a mushroom and includes a cap and a stem.

6. The adaptive x-ray filter as claimed in claim 3, further comprising:

a flexible second membrane arranged below the positioning elements, the flexible second membrane being moveable in a location-dependent manner hydraulically in a direction of the positioning elements, and as a result, the positioning elements operable to move in a direction of the first fluid such that the positioning elements locally change the layer thickness of the first fluid.

7. The adaptive x-ray filter as claimed in claim 1, further comprising:

a second fluid arranged below the flexible first membrane, an x-ray radiation absorption property of the second fluid being the same as an x-ray radiation absorption property of the positioning elements.

8. The adaptive x-ray filter as claimed in claim 7, wherein the positioning elements are surrounded by the second fluid.

9. The adaptive x-ray filter as claimed in claim 7, wherein each positioning element of the positioning elements is configured in the shape of a mushroom and includes a cap and a stem.

10. The adaptive x-ray filter as claimed in claim 7, further comprising:

a flexible second membrane arranged below the positioning elements, the flexible second membrane being moveable in a location-dependent manner hydraulically in a direction of the positioning elements, and as a result, the positioning elements operable to move in a direction of the first fluid such that the positioning elements locally change the layer thickness of the first fluid.

11. The adaptive x-ray filter as claimed in claim 1, further comprising:

a flexible second membrane arranged below the positioning elements, the flexible second membrane being moveable in a location-dependent manner hydraulically in a direction of the positioning elements, and as a result, the positioning elements operable to move in a direction of the first fluid such that the positioning elements locally change the layer thickness of the first fluid.

12. The adaptive x-ray filter as claimed in claim 11, further comprising:

a distributor plate arranged below the flexible second membrane, the distributor plate comprising supply lines for a third fluid, a hydraulic pressure being exertable on the positioning elements with the third fluid.

13. An adaptive x-ray filter for changing a local intensity of x-ray radiation, the adaptive x-ray filter comprising:

a first fluid operable to absorb at least some of the x-ray radiation; and positioning elements that are hydraulically moveable and are operable to change a layer thickness of the first fluid at a location of a respective positioning element of the positioning elements by at least partly displacing the first fluid, wherein each positioning element of the positioning elements is configured in the shape of a mushroom and includes a cap and a stem.

14. The adaptive x-ray filter as claimed in claim 13, further comprising:

a flexible first membrane separating the first fluid from the positioning elements; and a second fluid arranged below the flexible first membrane, wherein the positioning elements are surrounded by the second fluid.

15. An adaptive x-ray filter for changing a local intensity of x-ray radiation, the adaptive x-ray filter comprising:

a first fluid operable to absorb at least some of the x-ray radiation;

positioning elements that are hydraulically moveable and are operable to change a layer thickness of the first fluid at a location of a respective positioning element of the positioning elements by at least partly displacing the first fluid; and a flexible first membrane that is transparent for the x-ray radiation, the flexible first membrane separating the first fluid from the positioning elements, wherein the positioning elements are arranged in a plane at right angles to the x-ray radiation, in a honeycomb matrix, or in the plane at right angles to the x-ray radiation and in the honeycomb matrix.

16. The adaptive x-ray filter as claimed in claim 15, further comprising:

a cover plate arranged above the first fluid, wherein the flexible first membrane is pushable by the positioning elements, and wherein the cover plate and the flexible first membrane form a cavity for the first fluid.

17. The adaptive x-ray filter as claimed in claim 16, further comprising:

a second fluid arranged below the flexible first membrane, an x-ray radiation absorption property of the second fluid being the same as an x-ray radiation absorption property of the positioning elements.

18. A method for changing a local intensity of x-ray radiation using an adaptive x-ray filter, the method comprising:

hydraulically moving a positioning element of the adaptive x-ray filter arranged in a plane;

changing a layer thickness of a first fluid absorbing at least some of the x-ray radiation at a location of the positioning element, the changing comprising at least partly displacing, by the positioning element, the first fluid; and separating the first fluid from the positioning element by a flexible first membrane, wherein the flexible first membrane is moveable by the positioning element.

* * * * *